United States Patent [19]

Braithwaite et al.

[11] Patent Number: 4,457,642

[45] Date of Patent: Jul. 3, 1984

[54] APPARATUS FOR APPLYING LIQUID TO A SURFACE HAVING SAFETY VENT

[75] Inventors: John D. Braithwaite; Derrick O. King, both of Berkshire; Sidney J. Williams, Surrey; James Prior, Berkshire, all of England

[73] Assignees: Black & Decker Inc., Newark, Del.

[21] Appl. No.: 309,697

[22] Filed: Oct. 8, 1981

[30] Foreign Application Priority Data

Oct. 8, 1980 [GB] United Kingdom ..... 8032485

[51] Int. Cl.[3] ..... B05C 17/00; B05C 21/00

[52] U.S. Cl. ..... 401/188 R; 222/396; 222/397; 222/399; 401/146

[58] Field of Search ..... 401/188 R, 146; 222/396, 397, 399, 325

[56] References Cited

U.S. PATENT DOCUMENTS

| | | | |
|---|---|---|---|
| 2,160,043 | 5/1939 | Threm | 222/399 |
| 3,006,515 | 10/1961 | Midnight | 222/396 |
| 3,352,457 | 11/1967 | Tracy et al. . | |
| 3,558,010 | 1/1971 | Zenger . | |
| 3,603,694 | 9/1971 | Hamm . | |
| 3,640,630 | 2/1972 | Walker . | |
| 3,676,010 | 7/1972 | Kirch | 401/188 R |
| 3,776,645 | 12/1973 | Walker . | |
| 3,861,564 | 1/1975 | Loeffler . | |
| 4,003,505 | 1/1977 | Hardt | 222/397 |
| 4,422,788 | 12/1983 | Braithwaite et al. . | |

FOREIGN PATENT DOCUMENTS

| | | |
|---|---|---|
| 1449554 | 8/1966 | France . |
| 2006896 | 1/1970 | France . |
| 2109072 | 5/1972 | France . |
| 2216777 | 8/1974 | France . |
| 2301306 | 9/1976 | France . |
| WO80/00315 | 3/1980 | PCT Int'l Appl. . |

*Primary Examiner*—Steven A. Bratlie

*Attorney, Agent, or Firm*—Edward D. Murphy; Harold Weinstein; Ronald B. Sherer

[57] ABSTRACT

An apparatus for applying liquid to a surface includes an outer vessel, an inner liquid container which is housed within the outer vessel and which is substantially closed but includes an inlet for pressurized gas and a separate outlet for liquid, and means for supplying pressurized gas to the container. An interface of the container and the outer vessel is sealed around the inlet for pressurized gas whereby in use a region of the space between the outer vessel and the inner container is not pressurized. The unpressurized region of the outer vessel is vented. An applicator is connected via a length of flexible tube to the liquid outlet.

17 Claims, 6 Drawing Figures

APPARATUS FOR APPLYING LIQUID TO A SURFACE HAVING SAFETY VENT

FIELD OF THE INVENTION

This invention relates to apparatus for applying liquid to a surface. In particular the invention relates to an apparatus in which liquid is fed to an applicator under pressure. The invention has particular, but not exclusive, reference to the application of paint.

BACKGROUND OF THE INVENTION

It has been proposed to feed liquid to an applicator with an apparatus consisting of an inner liquid container in which the liquid is supplied to the user and an outer pressure vessel. Although the provision of an inner and outer container may at first sight seem unnecessary such a two container system has been found to possess various advantages: for example, it makes the system cleaner to use and it makes cleaning of the system after use easier.

In our International patent application, publication number WO 80/00315 published Mar. 6, 1980, and corresponding to our later published U.S. Pat. No. 4,422,788, an apparatus for applying liquid to a surface is described. In one of the embodiments described the apparatus has an inner paint container and an outer pressure vessel and in use pressurized gas is injected into the interior of the outer vessel, which is sealed, and passed into the inner paint container and expels paint from the inner container through a dip tube to an applicator connected to the apparatus by a flexible tube. It is proposed that paint be supplied to the user in the inner paint container which the user inserts into the outer vessel before use. Since it is proposed that the paint be supplied to the user in the inner paint container, it is important that this container be of relatively simple and cheap construction.

In U.S. Pat. No. 3,776,645 an apparatus is described in which an outer container is provided into which an open liquid container may be inserted. Liquid in the open topped container is expelled through a tube to an applicator by pressure generated by a squeeze bulb.

In U.S. Pat. No. 3,640,630 an apparatus is described including an outer vessel housing an open topped container in which a flexible plastics bag containing paint may be inserted. In order to regulate the pressure in the inner container, the container forms a seal with a wall of an outer vessel and when the pressure exceeds a threshold value, the seal is broken until the pressure returns to below the threshold value.

We have found that in order to ensure satisfactory feeding of the paint to the applicator and satisfactory application by the applicator the paint should possess special physical properties. It is therefore desirable that the apparatus be able to be used only with paint which has been designed specifically for use with the apparatus. The use of an unsuitable liquid may also damage the apparatus.

With the apparatus of U.S. Pat. Nos. 3,776,645 or 3,640,630, it would be possible for a user to take a conventional can of paint, remove the lid and place the can in the apparatus, or alternatively pour paint into the outer container. The apparatus could then be operated in the usual manner using the conventional paint.

Similarly, in the embodiment of our International patent application described above, it would be possible for a user to place a conventional paint can, instead of the inner paint container containing special paint, inside the outer vessel, or alternatively pour paint into the outer vessel. The apparatus therefore also has the disadvantage that it can be used with unsuitable paint. Although there is a reference in International patent application No. WO 80/00315 to providing means for preventing the insertion of an unsuitable container this would not prevent paint being poured directly into the outer vessel.

If any of the apparatus described above is used in these ways, then the apparatus could become defective or even dangerous as a result of paint penetrating to parts of the apparatus that it is not intended to reach. At the very least the apparatus would require extensive cleaning after such use.

Problems of safety can to some extent be overcome by introducing safety valves and similar features but there always remains the possibility of failure of these various safety mechanisms. It is therefore desirable that, even in the event of such safety mechanisms not taking effect, and the pressurized vessel bursting, the user is not seriously affected.

SUMMARY OF THE INVENTION

It is an object of the invention to provide an apparatus for applying liquid to a surface that overcomes at least some of the disadvantages mentioned above.

According to the invention there is provided an apparatus for applying liquid to a surface, the apparatus including an outer vessel, an inner liquid container which is housed within the outer vessel and which is substantially closed but includes an inlet for pressurized gas and a separate outlet for liquid, and means for supplying pressurized gas to the container, wherein an interface of the container and the outer vessel is sealed around the inlet for pressurized gas whereby in use a region of the space between the outer vessel and the inner container is not pressurized.

The provision of a seal between the inner container and outer vessel ensures in a simple manner that the apparatus is used only with the correct inner liquid container and therefore the correct liquid, unless extraordinary measures are taken by a user. The provision of an outer, substantially unpressurized, vessel around the liquid container makes the apparatus extremely safe since even if the liquid container fails to withstand the pressure within it and bursts, the outer vessel will retain the burst container.

Preferably the apparatus includes means providing fluid communication from the unpressurized region of the outer vessel to atmosphere. These means may be defined by at least one aperture in the wall of the outer vessel. An arrangement of this kind further ensures that the apparatus cannot be used without the inner liquid container and also, if the liquid container bursts, enables the excess pressure in the outer vessel to be vented preventing any possibility of that vessel bursting. As an alternative to providing an aperture, a pressure relief valve may be provided or a portion of the vessel wall weakened.

The base of the liquid container is preferably supported by the outer vessel; in this way the side wall of the liquid container does not have to withstand longitudinal stress but only hoop stress.

The container may be clamped in the outer vessel between its base and the rim of the top or lid of the container. This alleviates stress on the rim of the top or lid of the container, when in use the container is pressurized.

The means for supplying pressurized gas may include a pressurizing assembly including a housing for receiving a capsule of pressurized gas and pressure reducing means.

The apparatus may also include an applicator connected via a length of flexible tube to a feed conduit extending into the inner container and defining the liquid outlet thereof.

The seal around the inlet for pressurized gas may be defined by a seal member located between an inwardly facing sealing wall on the inner container and an outwardly facing sealing wall on the outer vessel. By making the sealing wall on the inner container face radially inwardly the risk of damage to the sealing wall is minimized.

The liquid container may have a container body and a lid on which the sealing wall is provided, there being a gas tight seal between the body and the lid, and the body and the lid being inseparable, or difficult to separate, by a user, at least without the aid of a tool. By making the container in two parts, filling of the container and manufacture of the container are facilitated. It is preferable that the body and the lid be inseparable by a user without the aid of a tool so that the user cannot fill up the paint container with unsuitable paint or place a can of unsuitable paint inside the paint container.

The apparatus may further include closure means for closing an aperture in the container, thereby completely closing the container, said closure means being removable before use to uncover said liquid outlet. The gas inlet and separate liquid outlet may both pass through the same aperture in the container or separate apertures may be provided.

A dip tube may be provided for feeding liquid from the liquid container and, in use, the dip tube may fill the aperture. With this arrangement there is substantially no leakage of liquid from the container during use, even if the apparatus is inverted and when, after use, the dip tube is withdrawn from the container, the dip tube is wiped by the aperture wall. In order to enhance the wiping action the wall of the container surrounding the dip tube is preferably flexible.

The base of the container may be provided with a deformable support deformable in response to a force on the base of the container exceeding a threshold value to cause the container to move within the outer vessel and break the seal therebetween. The deformable support may comprise a plurality of radially extending thin webs each lying in a plane which is vertical when the container is in an upright position. The container can be supported on these webs and, if the pressure in the container exceeds a safe value, the force on the base of the container exceeds the threshold value, the webs deform and the container moves breaking the seal with the outer vessel. Preferably the webs are made permanently deformable and the container cannot be used after such a malfunctioning of the apparatus, but alternatively the webs may be resiliently deformable.

The top of the inner container may be spaced below the top of the outer vessel with a chamber defined therebetween, the sides of the chamber being defined by the sealed interface of the inner container and outer vessel, the chamber being pressurised in conjunction with the interior of the inner container.

The inner container may contain paint.

According to another aspect of the invention there is provided an apparatus for applying liquid to a surface, the apparatus including an outer vessel carrying means for making an endless seal with an inner liquid container housed within the outer vessel, means for pressurising the inner container, an applicator, a liquid feed conduit extending from the interior of the vessel to the applicator, and means in a wall of the vessel outside the endless seal for providing fluid communication from the interior of the outer vessel to atmosphere.

BRIEF DESCRIPTION OF THE DRAWINGS

By way of example an embodiment of the invention will now be described with reference to the accompanying drawings, of which.

DETAILED DESCRIPTION OF THE PREFERRED EMBODIMENTS

Figure 1:
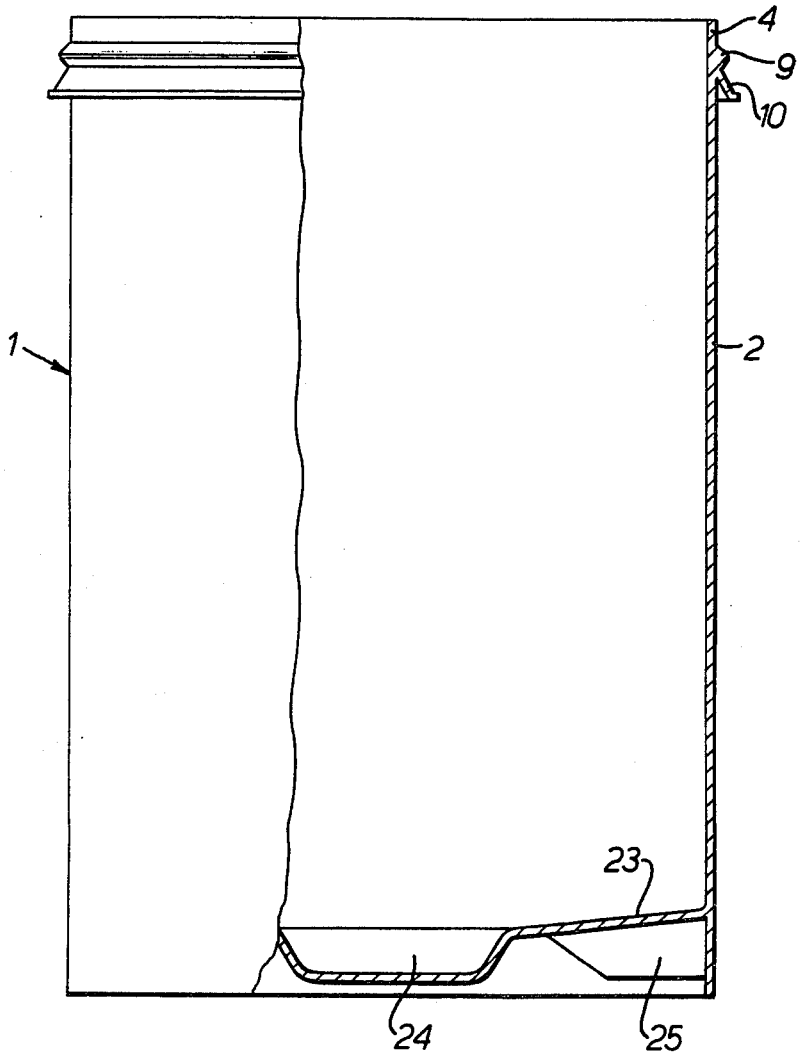
FIG. 1 is a partly sectional side view of a paint container without its lid.

Referring first to FIGS. 1 to 5, a paint container 1 having an internal volume of just over a liter made of plastics material and of circular cross-section has a body 2 and a lid 3. The lid 3 fits over the rim 4 of the top of the container body 2 and has a radially inwardly facing smooth sealing wall 5 extending in a complete circle of diameter 97.6 mm (within a tolerance of ±0.2 mm) around the centre of the container. A recess 6 is formed in the lid inwardly of the sealing wall 5.

The lid 3 has a resilient downwardly extending flange 7 formed with a protuberance 8 which engages under a corresponding protuberance 9 formed on the outside of the container body. Below the protuberance 9 the container body has a downwardly inclined flange 10 terminating in an outwardly projecting lip 11. The lip 11 and flanges 7 and 10 of the lid and container body are shaped such that they together define a substantially continuous outline to the container. This enhances the appearance of the container and also impedes removal of the lid from the container.

Figure 2:
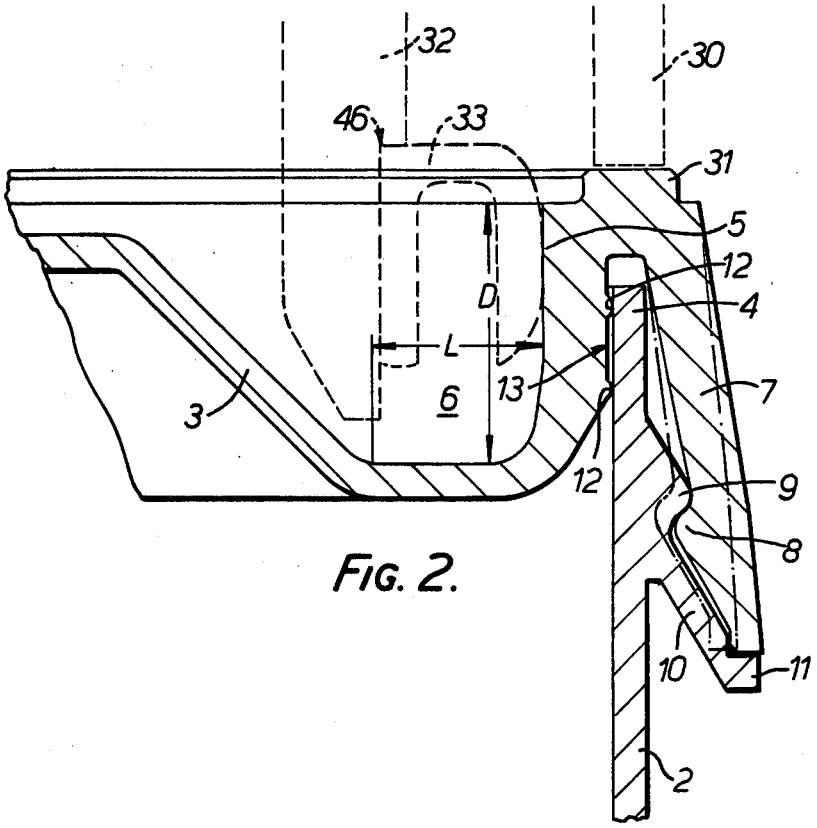
FIG. 2 is a sectional side view of part of the container to FIG. 1 showing the junction of the lid and the container.

The natural unstressed position of the flange 7 of the lid is approximately as shown in chain dotted outline in FIG. 2, but when the lid 3 is forced over the rim of the container, the flange 7 is flexed outwardly to the position shown. A pair of circumferential ribs 12, formed on the face 13 of the lid 3 which engages the inside of the container body 2, press against the container body and seal the lid to the body.

Figure 3:
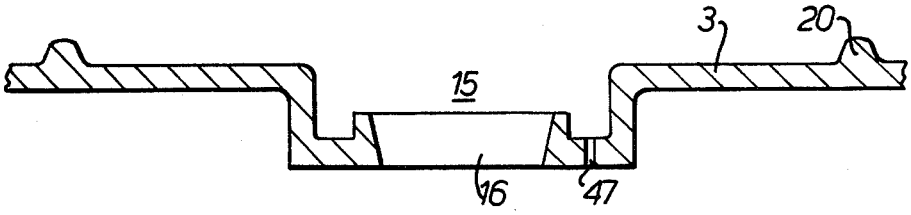
FIG. 3 is a sectional side view of the center portion of the lid of the container.
Figure 4:
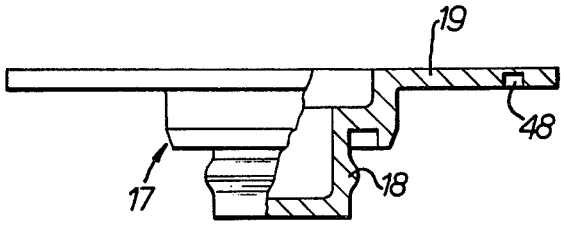
FIG. 4 is a partly sectional side view of a closure plug for the container.
Figure 5:
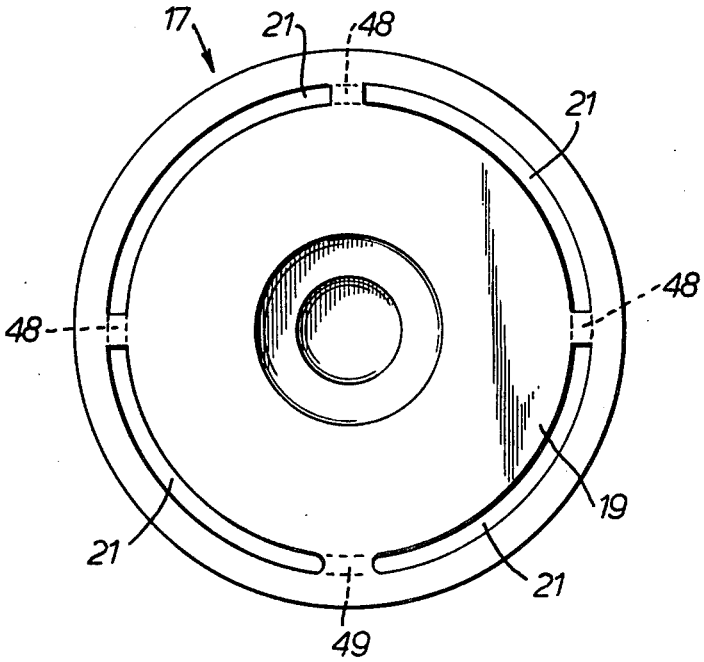
FIG. 5 is a plan view of the plug of FIG. 4.

As shown in FIG. 3, the lid 3 has a central recess 15 in which an aperture 16 is provided, the aperture being sized to receive a plug 17, shown in FIGS. 4 and 5.

When the plug 17 is fitted into the aperture 16, a protuberance 18 on the plug engages under the lower edge of the aperture 16 and the disc-shaped top 19 of the plug lies within the circular area defined by a rib 20 on the lid 3.

The plug 17 has a "ring pull" top. Four circumferential slots 21 are formed in the top 19 and these are joined by deep grooves 48 in the underside of the top. No groove is provided between two of the slots and this ungrooved portion defines a bridging web 49. Accordingly when, for the first time, a user lifts the edge of the top 19, the material tears at the three deep grooves 48 so that the outside of the top forms a ring by which a user may pull the plug out of the aperture 16.

Referring again to FIG. 1, the container body 2 has a transverse sloping bottom wall 23 that slopes downwardly to a well 24 at the centre of the container. Beneath the bottom wall 23 are twelve equiangularly spaced thin webs 25. Each web 25 extends radially inwardly from the peripheral wall of the container body 2 and is disposed in a vertical plane.

Figure 6:
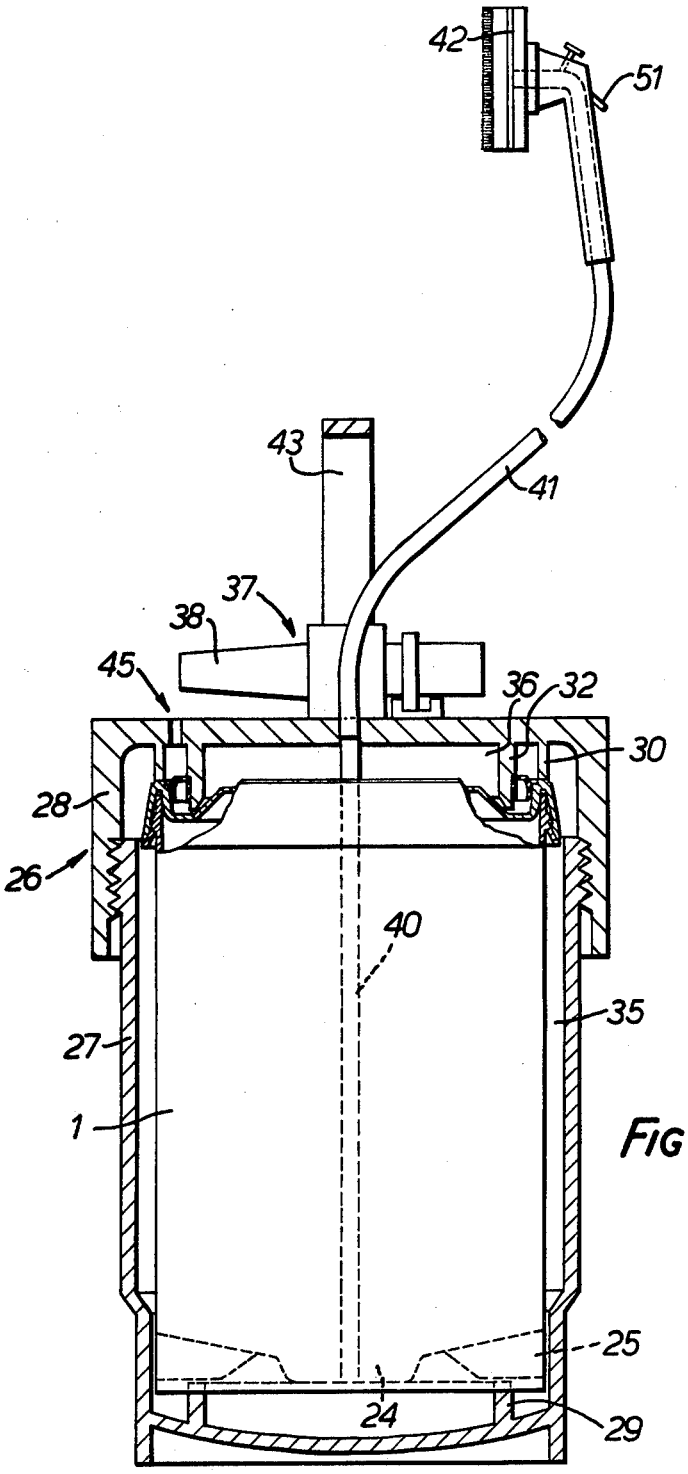
FIG. 6 is a partly sectional side view of a painting apparatus incorporating the container of FIGS. 1 to 5.

FIG. 6 shows the container 1 installed in a painting apparatus incorporating the container of FIGS. 1 to 3. The container 1, which is shown in sectional outline in FIG. 6, is placed in an outer vessel 26 which has a body 27 and a lid 28. At the bottom of the interior of the vessel 26 an annular rib 29 is provided on which the webs 25 sit edgewise supporting the container. The lid 28 of the vessel has a downwardly extending annular rib 30 which, when the lid 28 of the vessel is screwed fully onto the body 27, bears down on a raised portion 31 (see also FIG. 2) of the container. Thus the container 1 is clamped in the outer vessel between its base and the rim of the lid of the container.

Another annular rib 32 inside the rib 30 extends downwardly from the lid 28 of the vessel and a seal member 33 of inverted 'U' shaped cross-section is secured around the outside of the rib 32. The distal limb of the 'U' of the seal member 33 engages the sealing wall 5 of the container.

FIG. 2 shows the ribs 30, 32 and seal member 33 in dotted outline and it will be seen that the recess 6 accommodates the rib 32 and seal member 33. The depth of the sealing wall and the size of the recess 6 are chosen so as to provide an efficient seal. In this particular example of the invention the sealing wall 5 has a depth 'D' of 5 mm, (in another example the depth 'D' is 7.5 mm), and there is a free space projecting a distance 'L' of 5.1 mm radially inwardly of the sealing wall. The seal member 33 divides the space between the container 1 and the outer vessel 26 into a lower chamber 35 and an upper chamber 36.

A pressurizing assembly 37 is mounted on the lid 28 of the outer vessel and has an outlet (not shown) which passes through the lid 28 into the chamber 36. The pressurizing assembly 37 includes a housing 38 containing a capsule of pressurized gas and pressure reducing means in the gas flow path from the capsule to the chamber 36 for reducing the gas pressure from the capsule pressure which may be several hundred pounds per square inch to for example ten pounds per square inch. A particular form of pressurizing assembly that may be used is that shown in FIG. 3 of our previously referred to U.S. Pat. No. 4,422,788 and described therein, which description is incorporated in this specification by reference. Other suitable forms of pressurizing assembly are described in our British patent application, publication number 2066932, published July 15, 1981.

Sealingly mounted in an aperture in the centre of the lid 28 is the top of a dip tube 40 which extends through the chamber 36, through the aperture 16 (shown in FIG. 3) in the container and down into the well 24 at the bottom of the container. A flexible tube 41 which in this example is of internal diameter 5 mm is connected to the dip tube in the lid 28 and extends to an applicator 42 the design of which is not a significant part of the present invention and will not be described further. The tube 41 and the dip tube together have a length of about 1.4 mm.

A handle 43 of inverted 'U' shape is connected to diametrically opposite portions of the side of the lid 28 of the vessel, and a clip (not shown) is provided on one side of the handle to allow a user to clip the vessel to a belt or waistband.

Paint is purchased by a user in the container 1. The container body 2 is filled at the factory with a liter of paint and the lid 3 is then secured to the body 2 with the plug 17 fitted in the aperture 16; if desired, the plug may be sealed to the lid 3.

When the user wishes to use the apparatus, he removes the plug 17 from the aperture 16 and places the container 1 in the vessel body 27. He then takes the lid 28 of the outer vessel, together with the dip tube 40, flexible tube 41, applicator 42, handle 43 and pressurizing assembly 37 and inserts the dip tube 40 through the aperture 16, in which it is a close fit and screws the lid 28 onto the vessel body 27. In so doing the rib 30 on the lid is brought into engagement with the raised portion 31 on the container and the seal member 33 seals against the sealing wall 5 on the container.

In order to operate the device, the user adjusts the pressurizing assembly 37 allowing pressurized gas to pass into the chamber 36 from which the gas passes into the container 1 through an aperture 47 (FIG. 3) in the lid 3 of the container. Paint is expelled through the dip tube 40 and passes through the flexible tube 41 where it is applied to a surface by an applicator 42, which may be a pad, roller or brush, the applicator including control means 51 to control the flow of paint from the applicator.

When the user has finished painting he adjusts the pressurizing assembly 37 to the "off" position unscrews the lid 28 of the outer vessel, removes the dip tube 40 from the container 1 and replaces the plug 17 in the aperture 16 provided there is still some paint in the container 1. As the dip tube is removed from the container the wall of the aperture 16 wipes excess paint off the dip tube. In order to enhance the wiping action the dimensions of the lid around the aperture are chosen so that this part of the container wall is flexible. The only parts that require cleaning after use are the tubes 40, 41 and the applicator 42. Even if the apparatus is inverted during use, paint does not leak out of the container into the vessel.

Should the user attempt to use a can of conventional paint in place of the container 1 or pour paint directly into the outer vessel, the seal member 33 will not make a seal and pressurized gas entering the outer vessel will pass out of the vessel through the junction between the lid 28 and the vessel body 27 and also through one or more apertures 45 in the lid of the outer vessel. Furthermore the lid 3 is attached so securely to the body 2 of the container that it cannot be readily detached by a user without the aid of a tool so that it is difficult for the user to refill the container 1. The aperture 16 is so small that refilling the container through this aperture would be a difficult and laborious process.

Should the pressure reducing means of the pressurizing assembly malfunction leading to an increase in pressure in the chamber 36 and the container 1, the seal member 33 is forced upwardly past a shoulder 46 (shown in FIG. 2) formed on the rib 32 and blown into the space between the ribs 32 and 30. The pressurized gas is then able to escape the atmosphere through the one or more apertures 45. Even if the seal member remains in place there is yet another safety feature, namely that the pressure of gas pressing down on the container 1 becomes sufficient for the webs 25, on which the container sits, to be crushed causing the container to move down inside the vessel and move out of engagement with the seal member 33.

Thus it will be seen that quite apart from any safety devices incorporated in the pressurizing assembly, there are two distinct safety mechanisms provided in the coupling of the container and the outer vessel. Furthermore, even if the container were to burst, perhaps because of faulty manufacture of the container, the container and its contents will be confined within the outer vessel.

The use of an apparatus including an inner liquid container and an outer vessel at least a portion of which is not pressurized is of value not only where the application of paint is concerned but also in the application of other liquids. Although the provision of the outer vessel might appear unnecessary as the outer vessel is unpressurized, it does considerably improve the safety of the apparatus as described above.

The design of the container 1 with the sealing wall 5 is particularly significant in the case of a paint container, since only suitable paint should be used in a pressurized paint feed system, and the provision of the sealing wall 5 on the paint container means that only this sort of container and therefore the kind of paint in that container can be used.

While in the embodiment shown in the drawing the central portion of the lid 3 is raised, it will be understood that the lid 3 could extend straight across the container at constant depth D below the top of the container. The particular form of plug closure shown in the drawings has a "ring pull" top, but it will be appreciated that there are a variety of forms of closure that could be used. If desired a pressure indicator, either indicating the actual pressure in the vessel and container, or merely indicating whether or not the vessel is pressurized may be provided.

It may be desirable to make the rib 30 discontinuous and also to provide the one or more apertures 45 in the body of the vessel. This ensures that the seal member 33 cannot reseal once it has been blown off; the discontinuities in the rib 30 provide a venting path to atmosphere once the seal member has blown off.

A suitable paint for the system comprises film-forming resin together with pigment and/or extender in an aqueous medium, and having an efflux time viscosity, measured as the time required to pump 100 ml through a tube of internal diameter 5 mm and length about 1.4 m under conditions defined therein:

| Temp. (°C.) | Pressure (gauge) (kPa) | Pre-treatment | Permitted efflux time (seconds) |
|---|---|---|---|
| 20 | 69 | Storage overnight | about 40 to about 100 |
| 5* | 69 | Storage overnight | not more than about 120 |
| 30 | 69 | Storage overnight | not less than about 35 |
| 20 | 62 | Storage overnight | not more than about 120 |
| 20 | 103 | Storage overnight | not less than about 20 |
| 20 | 69 | Storage | about 40 to about 100 |

-continued

| Temp. (°C.) | Pressure (gauge) (kPa) | Pre-treatment | Permitted efflux time (seconds) |
|---|---|---|---|
| 20 | 69 | 3 Months 7 Freeze-thaw cycles | about 40 to about 100 |

*gloss paints tested at 10° C.

What is claimed is:

1. An apparatus for applying liquid to a surface, comprising:

an outer vessel;

an inner liquid container housed within the outer vessel;

a seal engaged between the outer vessel and the inner container and defining first and second chambers in said vessel between said vessel and said container, said seal preventing communication between said first and second chambers;

means, carried by said vessel and located in the interior thereof, for supporting said seal and allowing movement of said seal relative thereto, such movement enabling communication between said first and second chambers;

means for pressurizing said first chamber and the interior of said container for dispensing liquid from said container; and means, communicating with said second chamber, for venting said second chamber to atmosphere;

whereby malfunctioning of said pressurizing means leading to an excess pressure in said first chamber causes said seal to move relatively to said seal supporting means to place said first and second chambers in communication so enabling venting to atmosphere of said first chamber through said second chamber and said venting means.

2. An apparatus for applying liquid to a surface, comprising:

an outer vessel comprising a body and a lid;

a liquid container housed in said vessel;

said lid having a downwardly projecting wall extending into the interior of said vessel;

a seal member supported by said downwardly projecting wall and being movable upwardly relative thereto, said seal member being interposed between said downwardly projecting wall and said container to form a seal therebetween and define in the interior of said vessel a first chamber between said container and said lid and a second chamber between said container and said vessel;

a liquid conduit extending into the outer vessel and into said container for feeding liquid to means for applying the liquid to said surface;

means for pressurizing said first chamber and the interior of said liquid container to feed liquid to said applying means;

means for venting said second chamber to atmosphere; and said seal member moving upwardly relative to said downwardly projecting wall to break the seal between said first and second chambers and vent said first chamber to atmosphere via said second chamber and said venting means upon malfunctioning of said pressurizing means leading to an increase in the pressurizing of said first chamber.

3. The apparatus of claim 2, wherein said venting means comprises an open hole in said lid.

4. The apparatus of claim 2, wherein said downwardly projecting wall has a downwardly directed shoulder thereon spaced downwardly from said lid, and said seal member abuts said shoulder.

5. The apparatus of claim 2, wherein said seal member comprises a ring having a cross-section of inverted-U form, a leg of the inverted-U engaging the container, another leg of the inverted-U engaging said downwardly projecting wall, and a top portion of the inverted U connecting said legs being spaced downwardly from said lid.

6. The apparatus of claim 2, wherein said container has a top, said top having a recess therein defined around the outer periphery thereof by an inwardly facing sealing wall with which said seal member engages.

7. The apparatus of claim 6, comprising means, disposed in said top, for allowing communication between said first chamber and the interior of said container.

8. The apparatus of claim 2, wherein said lid has a second wall spaced outwardly from and surrounding said downwardly projecting wall, said second wall engaging a top portion of said container and clamping said container against a base portion of said vessel body.

9. The apparatus of claim 8, wherein said seal member is disposed between said downwardly projecting wall and said second wall and can move upwardly therebetween.

10. Apparatus for applying liquid to a surface, comprising:

an outer vessel comprising a body and a lid;

a liquid container housed in said vessel and supported by said body;

said lid being attached around the periphery thereof to said body and having a downwardly projecting wall spaced inwardly from said periphery and extending into the interior of said vessel, said wall having a shoulder thereon spaced downwardly from a top portion of said lid;

a sealing ring mounted on said wall and engaging below said shoulder, said sealing ring forming a seal between said wall and said container to define in the interior of said vessel a first chamber between said container and said lid and a second chamber between said container and said vessel;

a liquid conduit extending into said outer vessel and into said container for feeding liquid to means for applying the liquid to said surface;

means, mounted on said vessel, for pressurizing said first chamber and the interior of said liquid container to feed liquid to said applying means;

means for venting said second chamber to atmosphere; and said sealing ring having an inverted-U cross-section with one leg of the inverted-U engaging said wall, the other leg of the inverted-U engaging said container, and a space remaining between the top of the inverted-U and said top portion of said lid;

whereby malfunctioning of said pressurizing means leading to an excess pressure in said first chamber causes said sealing ring to be blown upwards into said space to break said seal and vent said first chamber to atmosphere via said second chamber and said venting means.

11. The apparatus of claim 10, wherein said container comprises a top having a recess therein surrounded by an inwardly facing sealing wall which is engaged by said other leg, said downwardly projecting wall being spaced inwardly of said sealing wall.

12. The apparatus of claim 10, wherein said venting means comprises a hole in said lid.

13. The apparatus of claim 10, wherein said pressurizing means comprises a housing for a capsule of pressurized gas and communicates with said first chamber, and said container has an aperture therein for communication between said first chamber and the interior of said container.

14. The apparatus of claim 10, further comprising means for yieldably supporting said container by said body and allowing downward movement of said container to break said seal upon occurrence of excess pressure in said first chamber if said seal has not already been broken by being blown upwards into said space.

15. Apparatus for applying liquid to a surface, comprising:

an outer vessel having a body and a lid;

a liquid container housed in said vessel and spaced below said lid;

a seal member engaged between said vessel and said container and forming a seal therebetween and separating the interior of said vessel into a first chamber and a second chamber;

means for pressurizing said first chamber and the interior of said container for dispensing liquid from said container;

a vent in said vessel communicating with said second chamber and venting said second chamber to atmosphere;

said seal member being located below said lid with a space between said seal member and said lid into which said seal member can be displaced upon occurrence of excess pressure in said first chamber to break said seal thereby venting said first chamber to atmosphere via said second chamber; and means for yieldably supporting said container in said vessel and allowing downward movement of said container relative to said vessel to break said seal upon occurrence of excess pressure in said first chamber if said seal has not already been broken by displacement of said seal into said space.

16. The apparatus of claim 15, wherein said lid has a downwardly extending wall, said seal member comprises a ring carried by said wall around the outside thereof, and said container has a sealing wall engaged by said ring, said sealing wall being spaced outwardly from and surrounding said downwardly extending wall.

17. The apparatus of claim 16, wherein said ring has a cross-section in the form of an inverted-U.

* * * * *